US008309868B2

(12) United States Patent
Tuin et al.

(10) Patent No.: US 8,309,868 B2
(45) Date of Patent: Nov. 13, 2012

(54) MINIATURE SWITCH CONNECTOR

(75) Inventors: Jacobus Nicolaas Tuin, Best (NL); Juergen Haans, Helmond (NL); Jeroen Dittner, S-Hertogenbosch (NL); Jan Broeksteeg, Oss (NL); Dennis Halberstadt, Rosmalen (NL); Yves Braem, Ghent (BE); Patrick Marcel Duquerroy, Seligenstadt-Froschhausen (DE); Lieven DeCrock, Roselare (BE)

(73) Assignee: Tyco Electronics Nederland BV, 'S-Hertogenbosch (NL)

( * ) Notice: Subject to any disclaimer, the term of this patent is extended or adjusted under 35 U.S.C. 154(b) by 242 days.

(21) Appl. No.: 12/802,030

(22) Filed: May 28, 2010

(65) Prior Publication Data

US 2010/0304589 A1 Dec. 2, 2010

(30) Foreign Application Priority Data

May 29, 2009 (EP) ..... 09007203

(51) Int. Cl.
*H01H 33/96* (2006.01)

(52) U.S. Cl. ..... 200/51.12; 200/51.1; 439/188

(58) Field of Classification Search ..... 200/51.12, 200/51.1, 51.09; 439/188, 63.944
See application file for complete search history.

(56) References Cited

U.S. PATENT DOCUMENTS

| | | | | |
|---|---|---|---|---|
| 5,625,177 | A | 4/1997 | Yukinori et al. | |
| 6,099,334 | A * | 8/2000 | Togashi | 439/188 |
| 6,393,698 | B1 | 5/2002 | Kuriyama et al. | |
| 6,761,571 | B2 * | 7/2004 | Hida | 439/188 |
| 6,880,082 | B2 * | 4/2005 | Ohta | 713/168 |
| 8,011,939 | B2 * | 9/2011 | Braem et al. | 439/188 |
| 8,038,450 | B2 * | 10/2011 | Nakagawa | 439/63 |
| 8,066,516 | B2 * | 11/2011 | Hoshiba et al. | 439/63 |
| 2004/0175978 | A1 | 9/2004 | Mugiuda et al. | |
| 2006/0128195 | A1 | 6/2006 | Chen | |

FOREIGN PATENT DOCUMENTS

| | | | |
|---|---|---|---|
| EP | 1 039 588 | A2 | 9/2000 |
| EP | 1 788 669 | A2 | 5/2007 |
| EP | 1 278 274 | B1 | 9/2007 |
| GB | 2 307 113 | A | 5/1997 |
| GB | 2 351 617 | A | 1/2001 |
| WO | WO 98/31078 | A1 | 7/1998 |
| WO | WO 2004/077626 | A1 | 9/2004 |

* cited by examiner

*Primary Examiner* — Xuong Chung Trans
(74) *Attorney, Agent, or Firm* — Faegre Baker Daniels LLP

(57) ABSTRACT

The invention relates to a Switch connector for mounting on a printed circuit board, adapted to receive a mating connector in an insertion direction along an insertion axis. The switch connector comprises a shield, a contact element, and a contact spring having at least one fixed leg, at least one elastically deflectable switching leg, and at least one spring bend, the fixed leg and the switching leg extending from the spring bend in a common direction and passing the insertion axis. The switching leg is adapted to be moved by insertion of the mating connector from a rest position, at which the switching leg exerts a spring force onto the contact element, to a switching position, at which the switching leg is spaced apart from the contact element, at least one spring force flux that in the rest position is generated by the switching leg and guided in a closed loop to the fixed leg. To increase the reliability of the switching function, the shield is arranged in the closed loop of the spring force flux.

12 Claims, 5 Drawing Sheets

MINIATURE SWITCH CONNECTOR

This application claims priority from EP patent application 09007203.4 filed May 29, 2009, the subject matter of which is incorporated herein by reference.

The invention relates to a switch connector for mounting on a printed circuit board, adapted to receive a mating connector in an insertion direction along an insertion axis, the switch connector comprising: a shield, a contact element, and a contact spring having at least one fixed leg, at least one elastically deflectable switching leg, and at least one spring bend, the fixed leg and the switching leg extending from the spring bend in a common direction and passing the insertion axis, the switching leg being adapted to be moved by insertion of the mating connector from a rest position, at which the switching leg exerts a spring force onto the contact element, to a switching position, at which the switching leg is spaced apart from the contact element, at least one spring force flux that in the rest position is generated by the switching leg and guided in a closed loop to the fixed leg.

Switch connectors are, for example, used in mobile phones, in wireless LAN devices, in radio systems and in remote measuring equipment to provide the possibility to connect an external antenna. If the external antenna is connected, the internal antenna of the device is disconnected by the switching function.

Switch connectors are also known for connection of test probes to a printed circuit board for testing parts of said printed circuit board.

U.S. Pat. No. 5,625,177 discloses a switch connector to be mounted on a printed circuit board. The connector comprises a mating portion corresponding to a second coaxial connector, having an inner conductor and an outer conductor separated from the inner conductor by a dielectric. The connector has a movable switching leg, arranged under an insertion opening and electrically connected to a printed circuit board. The switching leg abuts to a second circuit portion electrically connected to a second portion of the printed circuit board. When a plug-in contact is inserted into the insertion opening the spring arm is deflected and thereby the contact between the spring arm and the second contact portion is separated. At the same time an electrical contact between the plug-in connector and the spring arm is closed.

GB 2307113 A describes a coaxial connector for connecting an external antenna to a mobile telephone. The connector comprises a housing having an insertion opening adapted to receive a mating coaxial connector in an insertion direction and a switch having first and second contacts with portions for connection to a printed circuit board. A switching leg extends between the first and second contacts, the switching leg being biased into a position in which it connects the two contacts electrically. A pressure applied by a plug-in conductor to the contact portion of the switching leg deflects the switching leg elastically so as to disconnect the electrical contact.

WO 98/31078 A describes a further coaxial connector assembly for connecting an external antenna to a mobile phone. The coaxial connector is mounted on a printed circuit board within a device such as a portable phone. The connector comprises a contact spring having one spring leg extending from a form fit in the housing through an insertion path of a contact pin to a contact leg. In unmated state the contact spring is contacted with the contact leg. When a counter connector is mated with the coaxial connector, a plug-in contact of the counter connector abuts against the center pin to push the same downward. As a result, the connection between the contact spring and the contact leg is interrupted.

GB 2351617 A describes a similar coaxial connector with a central pin which interacts with the resilient leg of a contact spring to operate as a switch.

From EP 1039588 A2 a switch connector for mounting on a printed circuit board is known, which has a center contact that is formed by a cylindrical protrusion on a spring leg. When a plug-in contact is inserted into an insertion opening, the spring leg is moved in mating direction so that the electrical contact between the end portion of the spring leg and a counter contact on the printed circuit board is disconnected.

EP 1278274 B1 describes a coaxial switch connector assembly for use in a mobile phone. A first coaxial connector is mounted on a printed circuit board of the mobile phone and comprises a contact spring which is fixed to the first connector. A contact spring forms an inner contact of the first coaxial connector and protrudes with a U-shaped portion as a tip from a mating face. Upon mating of the first and second coaxial connector the inner contact of the contact spring is pushed down so as to separate its contact portion from the counter contact portion.

The design of the springs of these known types of connectors necessitate large housings if a suitable deflection of the spring is to be obtained.

WO 2004/077626 A1 discloses a switch connector having a contact spring with a fixed leg and a switching leg which are mutually connected via a spring bend. If a counter plug-in contact is not mated to the connector the free end of the switching leg rests against a stop of a housing of the connector. The stop belongs to a region with a metallic coated surface, thus resulting in electrical contact between the switching leg and the stop and therefore between the switching leg and a conductor of the printed circuit board. A plug-in contact is inserted into the housing that raises the free end of the switching leg from the electrically conductive stop.

Coaxial switch connectors having a shield which is mounted on an insulated housing are disclosed in U.S. Pat. No. 6,393,698 B1, US 2004/0175978 A1, US 2006/0128195 A1, and EP 1 788 669 A2. To implement the switching function the shown switching connectors are provided with a contact spring consisting of an elastically deflectable leg. The contact springs are clamped at one end of an insulating housing and from there extend transversally to an insertion direction through an insertion opening.

Due to the clamping connection spring forces act directly onto the housing, resulting in torques and thereby increasing the deformation of the insulating housing. As the housing is typically made of plastics, it tends to be weakened when the connector is soldered in a reflow oven. As the spring terminals of these switching connectors serve as clamping members, heat passing into the spring terminal when the contact spring is soldered directly accesses the housing and thereby weakens the portions of the housing supporting the contact spring. This weakening of the housing may jeopardize the contact force generated by the spring, as the contact spring will move under the load of the contact force due to stress relaxation of the housing.

The non-published European patent application EP 08 004 517.2 discloses a switch connector having a contact spring comprising a fixed leg and an elastically deflectable switching leg extending from a spring bend in a common direction. To improve the support of the spring force both the switching leg and the fixed leg extend into a C-shaped contact element. As both the switching leg and the fixed leg extend to the C-shaped contact element, the stroke of the switching leg is limited by the span of the contact element.

Thus, the invention strives for providing a miniature switch connector having an increased reliability of the switching function.

This object is achieved by arranging the shield in the closed loop of the spring force flux.

By this solution the shield directly supports the contact spring. A reduction of the spring force caused by a relaxation or deformation of an insulating housing is avoided. As a shield can be arranged at the outer surface of the connector, the maximum stroke of the switching leg can be increased.

To directly receive the spring force flux or to shorten the spring force flux and to support the contact force from two opposing sides, the shield can form a clamp, said clamp surrounding the fixed leg and the switching leg. In this advantageous embodiment, relatively thin portions of insulating material can be arranged between the shield and the spring legs to minimize a spring force loss by elastic deformation or relaxation of the insulating material.

In a further advantageous embodiment the shield may comprise at least one support member, the fixed leg in a projection direction which points in insertion direction arranged in front of the support member. The support member can engage in insertion direction behind the fixed leg and thereby directly support the spring at the fixed leg, shortening the force flux within the switch connector.

To further increase the force transmission from the contact spring to the shield, the fixed leg may comprise a supported portion, the supported portion abutting the support member in insertion direction at the insertion axis. Thus, the spring force is transmitted to the support member in line with a switching force acting through a mating connector which is inserted to the insertion opening. Preferably, the supported portion of the contact spring abuts the support member at a center plane of the insertion opening extending parallel to the insertion direction. By this advantageous solution the spring force flux at a mated state of the switch connector lies on the center plane and no moments of tilt act on the contact spring.

In a further advantageous embodiment of the switch connector according to the invention, the switch connector can comprise a housing, the shield encompassing the housing. The housing as well as the contact spring can be supported by the shield serving as a framework to ascertain the position of the contact spring, the contact element and the shield within the switching connector. The housing, which is preferably made of plastic material, can serve as insulation, insulating the shield, the contact spring and the contact element electrically. Portions of the housing arranged between the contact element and the shield and/or the contact spring and the shield may serve as force transmission insulations.

To increase the stroke or possible deflection of the switching leg, the fixed leg can comprise at least two prongs, a gap between the prongs adapted to receive the switching leg. When mating the switching connector, the switching leg may be deflected by the mating connector towards the fixed leg. By forming the fixed leg like a fork having two prongs, the switching leg can be moved beyond the fixed leg into the gap between the prongs.

In a further advantageous embodiment, the contact element can have a substantially U-shaped profile, an opening of the U-shaped profile pointing towards the shield. Hence, the electrically conducting portions of the contact element can be arranged at a greater distance from the shield, and the likelihood of a leakage of electromagnetic signals from the contact element to the shield or from the shield to the contact element is reduced.

To facilitate manufacturing and mounting of switch connectors according to the invention a plurality of switch connectors may be configured to build up a connector arrangement. To reduce manufacturing costs and to further improve the spring support, the shields of the switch connectors comprised by the arrangement can be found from a common integral shield body. The shield body may preferably be stamped from a sheet metal.

To further decrease manufacturing and mounting costs, the housings of the switch connectors comprised by the connector arrangement also can be formed from a common integral housing body, preferably from injection molded plastics.

With regard to an advantageous embodiment of the connector assembly comprising a switch connector according to the invention, the mating connector can be configured to exert a switching force onto the switching leg, the switching force directed perpendicularly to the support member and towards the center of the support member. This solution allows for aligning the switching force with a resulting support force transmitted by the shield onto said contact spring. Thus, when making the connector assembly, no torques result from the switching force and the load and/or deformation of the switch connector is decreased.

In a further advantageous embodiment of the connector assembly according to the invention, the mating connector may comprise a ground conductor, the shield of the switch connector having a locking portion and the ground conductor having a counter-locking portion. The locking portion can be adapted to interfere with the counter-locking portion at a mated state of the connector assembly and to connect the ground conductor electrically to the shield. By integrating the function of locking the mating connector to the switch connector, providing an electromagnetic shielding and a ground conductor and/or transmitting the switching force from the mating connector to the switch connector, the dimensions of the switch connector can be miniaturized to a greater extent.

To increase the maximum deflection of the switching leg of the contact spring, the contact spring can be substantially S-shaped in a viewing direction pointing transversally to a switching direction. The switching direction is the moving direction of the switching leg or of a contact portion of the switching leg abutting the contact element, when a mating connector is inserted into the switch connector.

The invention is described hereinafter by means of example referring to an example of an embodiment with reference to the drawings. The various features of the described embodiment and the advantages to be achieved with it can be combined or omitted independently of one another, as can already be seen from the above configurations. The drawings.

Figure 1:
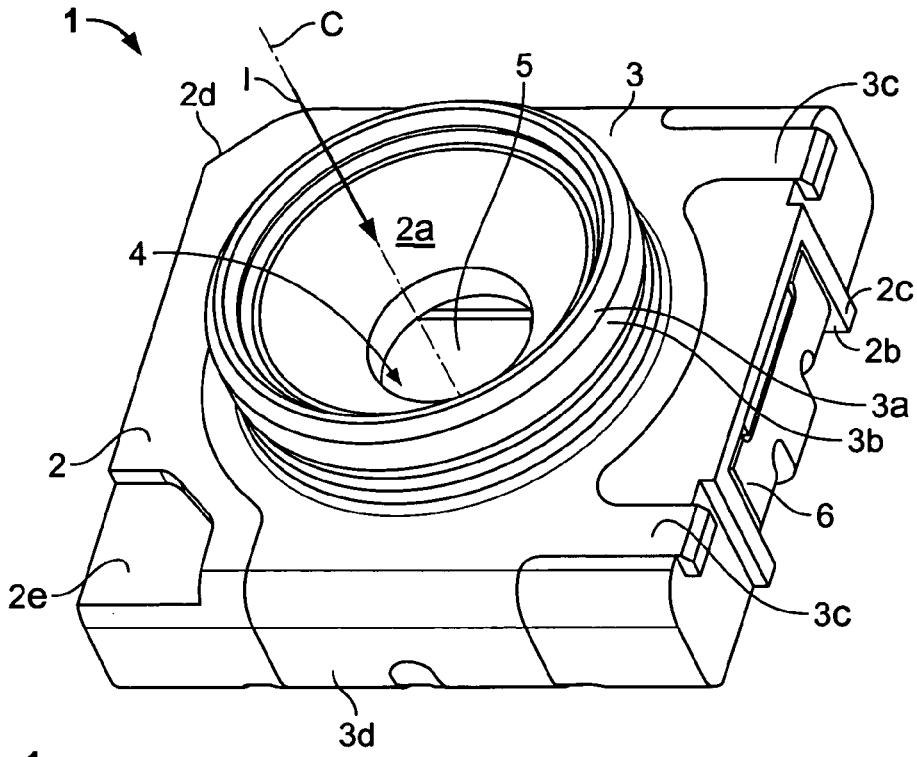
FIG. 1 is a schematic perspective view of a switch connector configured according to the invention.

First of all, the construction of a switch connector 1 configured according to the invention will be described with reference to FIG. 1, which shows a schematic perspective view of a switch connector configured according to the invention.

The switch connector 1 comprises a housing 2 on which a shield 3 is arranged. The housing 2 is provided with an insertion opening 4. The insertion opening 4 is surrounded by a funnel-shaped portion 2*a* of the housing 2, which tapers in insertion direction I, and by a flange 3*a* of the shield 3.

The insertion opening 4 serves for receiving a mating connector, preferably a coaxial connector. A center conductor of a mating connector can be inserted in insertion direction I into the insertion opening 4 while a ground conductor of the mating connector is connected to the shield 3. For connecting a mating ground conductor electrically and mechanically to the shield 3, at the flange 3*a* a locking portion 3*b* is disposed, which is formed as a circular notch or groove. For contacting the shield 3 electrically, the shield 3 has contact portions 3*c*, which protrude from the housing 2. Clamp members 3*d* on opposing sides of the shield 3 encompass the housing 2 and engage under the housing 2. By the clamp members 3*d* the shield 3 is fittingly attached to the housing 2.

The housing 2 is provided with a receptacle 2*b* for receiving a contact element 6. The contact element 6 is in a unmated state connected electrically to a contact spring 5. The contact spring 5 extends transversally to the insertion direction I through an insertion axis C and thereby allows a center conductor of a mating connector, which is inserted into the insertion opening 4 to abut the contact spring 4. The opening of the receptacle 2*b* is surrounded by a frame 2*c* which serves as stop to protect the contact spring 5 or the contact portions 3*c*. By a chamfered edge 2*d* of the housing 2 and/or a recess 2*e* on the top side of the housing 2 the position of the switch connector 1 can be identified when the switch connector 1 is mounted on a printed circuit board.

In a viewing direction parallel to the insertion direction I the switch connector has a substantially rectangular or square shape wherein the lateral lengths of the square are about 2 mm and the height in insertion direction I of the switch 1 is about 1 mm. Due to these small dimensions there are special requirements to the resilient characteristics of the contact spring 5. The spring must have a sufficient displacement and spring force to realize a good switch function.

Figure 2:
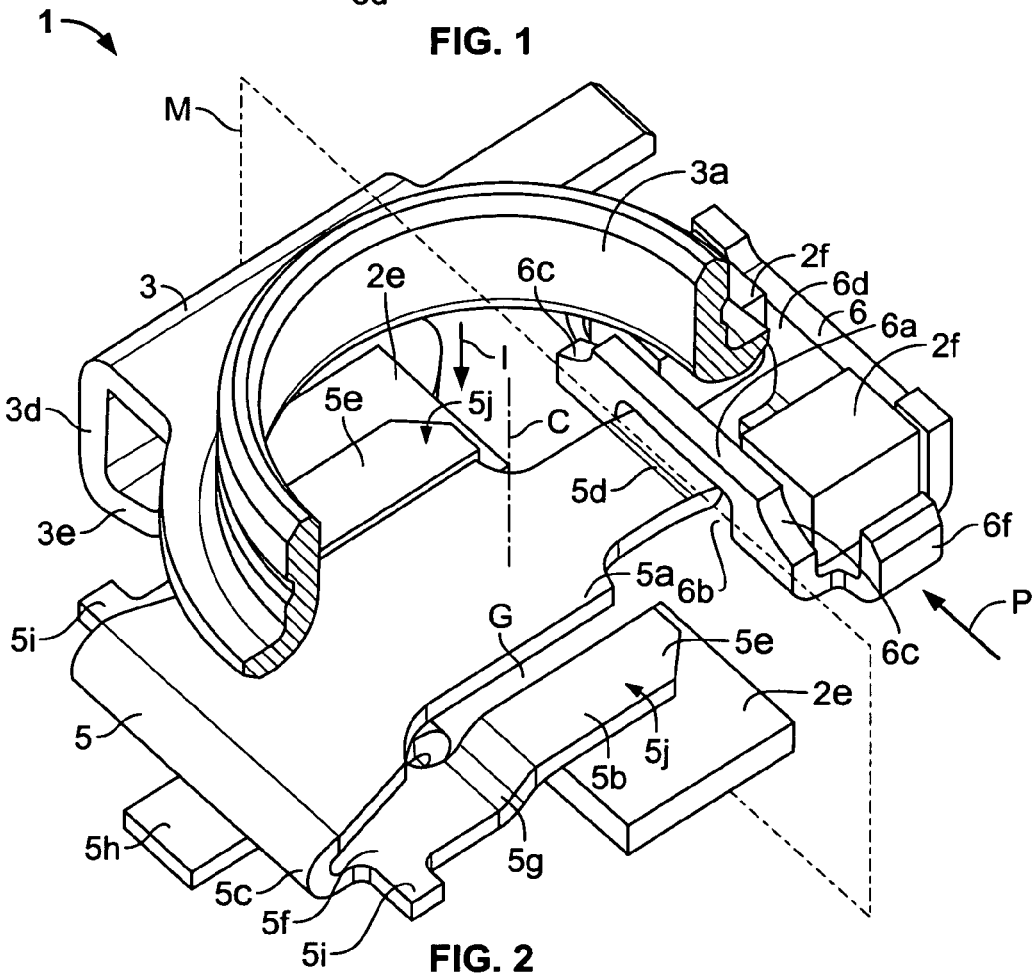
FIG. 2 is a schematic perspective sectional view of a switch connector configured according to the invention without a housing.

FIG. 2 is a schematic perspective view of the switch connector 1 without the housing. The shield 3 is shown in a sectional view.

The contact spring 5 comprises a switching leg 5*a* and a fixed leg 5*b* which are connected to each other by a spring bend 5*c*. The switching leg 5*a* has a contact portion 5*d* extending into a contact element 6. At the shown unmated state of the switch connector 1, a spring force is transmitted to the contact element 6 at the contact portion 5*b*. This spring force generated by the contact spring 5 is supported by the fixed leg 5*b*. For this purpose, the fixed leg 5*b* is provided with two supported portions 5*e*. The supported portions 5*e* are supported by the shield 3. To support the supported portions 5*e*, the shield 3 is provided at the clamping members 3*d* with support members 3*e*, which are formed from portions of the clamping members 3*d* and extend transversally to the insertion direction I towards the spring 5. As the support members 3*e* are arranged at the bottom side of the shield 3, they can furthermore serve as terminal to connect the shield electrically to a circuit, for example a printed circuit board.

The fixed leg 5*b* comprises two prongs 5*j* which are in insertion direction I arranged parallel and adjacent to the fixed leg 5*a*. The prongs 5*j* border a gap G which is wider than the broadness of the switching leg 5*a*.

To shorten the spring force flux flowing from the supported portions 5*e* of the spring 5 to the support members 3*e*, the supported portions 5*e* are, in a projection direction which points in insertion direction I, arranged in front of the support members. To improve the force flow from the supported portions 5*e* to the support members 3*e*, the supported portions 5*e* are adjacent to a base portion 5*f* of the fixed leg 5*b* provided with a curved portion 5*g*. The substantially S-shaped curved portion 5*g* arranges the supported portions parallel to the support members 3*e* disposed beneath and perpendicular to the insertion direction I.

The contact spring has a spring terminal 5*h* that is arranged below the fixed leg 5*b* and extends contrary to the switching leg 5*a* and the fixed leg 5*b*.

The supported portions 5*e* of the spring 5 rest on insulating portions 2*e* which are situated between the support members 3*e* and the supported portions 5*e*. The insulating portions 2*e* are made of electrically insulating material, preferably plastics, and can be a portion of the housing 2. Further insulating portions 2*f* are positioned within the contact element 6. As well as the insulating portions 2*e*, the insulating portions 2*f* transmit the spring force generated by the contact spring 5 up to the shield 3. For building a force closure or a spring force transmission between the contact element 6 and the shield 3, the insulating portions 2*f* are provided with supporting faces pointing in and against the insertion direction I and abutting in insertion direction I the contact element 6 and against the insertion direction I the bottom side of the shield.

In a projection direction P the contact element 6 has a U-shaped profile which opens against the insertion direction I. The U-shaped profile improves significantly the RF performance of the switch connector. The contact element 6 has a opening 6*d*, which points towards the bottom side of the shield 3 or of the flange 3*a*. Thus, the U-shaped profile allows for an increased distance between the contact element 6 and the shield 3 or between the main parts of the body of the contact element 6 and the shield 3. Hence, the leakage of electromagnetic radiation transmitted from the contact element 6 to the shield 3 or from the shield 3 to the contact element 6 is reduced.

Adjacent to the contact portion 5*b* of the contact spring 5*a* contact portion 6*a* of the contact element 6 is arranged. The contact portion 6*a* is formed from a lateral wall of the U-shaped profile. To receive the contact portion 5*d* of the contact spring 5, which is arranged at the end of the switching leg 5*a*, the side wall of the contact element 6 is formed like a bridge or an archway which spans an aperture 6*b*. The contact portion 5*d* extends into the aperture 6*b* and, due to the spring force generated by the contact spring 5, presses onto the inner side of the archway. To further improve the RF performance of the contact element 6, both ends of the side wall having the contact portion 6*a* are provided with recesses 6*c*. The recesses 6*c* are situated adjacent to the shield 3 or the flange 3*a*, increase the distance between the shield 3 and the contact element 6 and thereby decrease the leakage of RF signals.

On sides opposing in direction P, transversally to the extension of the spring legs 5*a*, 5*b*, the contact element 6 is provided with side walls 6*f*. The sidewalls 6*f* are formed from rectangular protrusions, which are bent upwardly against the insertion direction I. As on both sides of the sidewalls 6*f* gaps are arranged which are nearly as broad as the side walls 6*f*, the side walls 6*f* do not close the U-shaped Profile of the contact element 6.

At the bottom side of the contact element 6 pointing in insertion direction I, a contact element terminal 6*e* is formed from a protrusion extending in insertion direction I and bent towards the insertion axis C. The contact element 6 can be connected electrically, i.e. to a printed circuit board, by soldering.

The insertion axis C of the insertion opening 4 lies on a mid-plane M. The mid-plane forms a plane of symmetry of the shield 3. As well as the clamping members 3*d* and the support members 3*e* of the shield 3 the supported portions 5*e* of the contact spring 5 are arranged substantially symmetrically to the center plane M. When a central conductor or a central pin of a counter connector is inserted into the insertion opening 4, the center conductor is aligned with the insertion axis C. Thus, a switching force exerted by the center conductor onto the contact spring 5 lies on the insertion axis C and on the center plane M. As the switching force acting on the switching leg 5*a* and the counteracting forces at the supported portions 5*e* are arranged on the center plane M, no torsion moments are generated when a mating connector is mounted and the spring force flux is kept short. As well as the arrangement of forces and counteracting forces, the spring force flux extends symmetrically to the center plane M when a mating conductor is connected.

As well as the shield 3 and the contact element 6, the contact spring 5 is preferably stamped from sheet metal. The switching leg 5*a* and the fixed leg 5*b* extend, starting from the spring bend 5*c*, in a common direction. In contrast, the spring terminal 5*h* is bent in an opposing direction. The spring terminal 5*h* as an integrated part of the contact spring 5 may be cut out from the portion of a metal strip which later forms the fixed leg 5*b*. The metal strip is cut out beginning from the support portions 5*e* of the fixed leg 5*b* in the direction of the spring bend 5*c*. The spring bend 5*h* extends parallel to the switching leg 5*a* to a position lying under the spring bend 5*c*.

On opposing sides of the spring bend 5*c* the contact spring 5 is provided with fixation elements 5*i*. When the switch connector is mounted the fixation elements 5*i* are inserted into guiding notches of the housing. The guiding notches have an end with a face serving as stop for terminating the insertion movement of the contact spring 5 when the switch connector is mounted. Further, by deposing the fixation elements 5*i* within guiding notches of the housing, the fixation elements 5*i* avoid tilting of the contact spring 5 due to the spring force or a switching force exerted by a mating connector.

Figure 3:
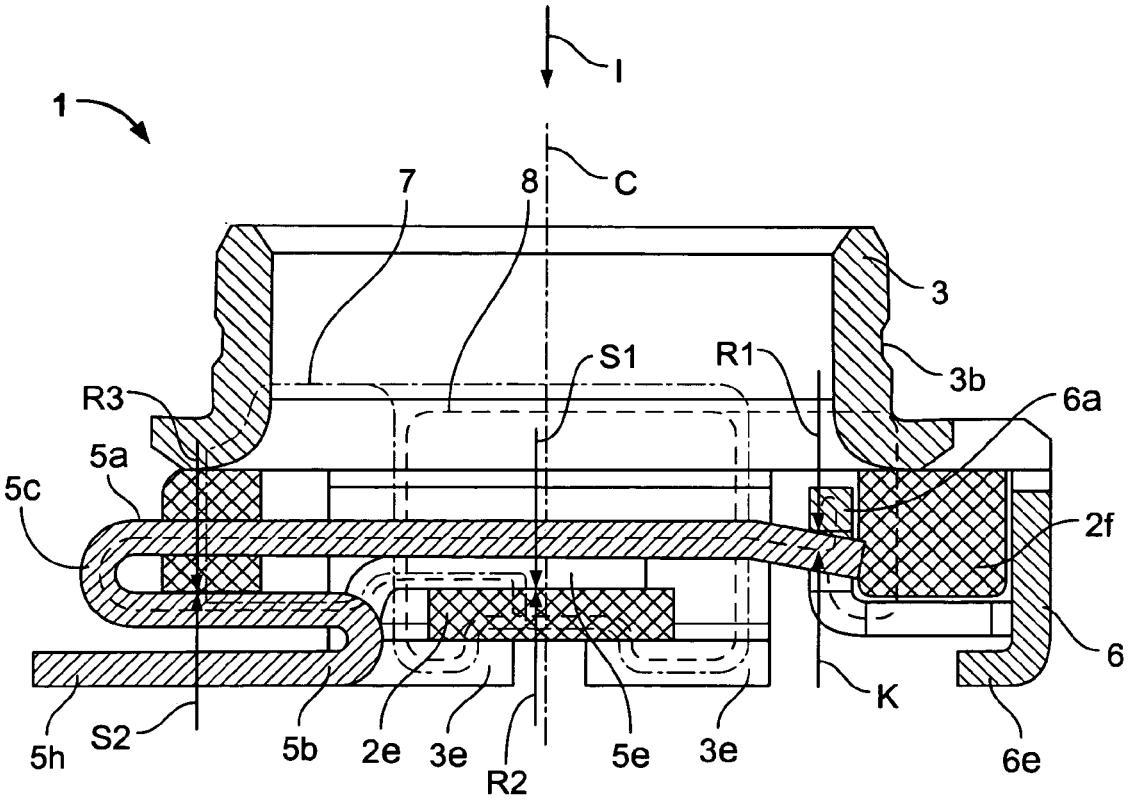
FIG. 3 is a schematic sectional side view of a switch connector according to the invention without a housing.

FIG. 3 is a cross-sectional side view of the switching connector according to the invention without a housing.

The semi-circular spring bend 5*c* connects the fixed leg 5*b* to the switching leg 5*a*. The switching leg 5*a*, starting from the spring bend 5*c* runs parallel to the fixed leg 5*b* to approximately ⅞ of its length and from there with a flat angle downwards in the direction of the contact portion 6*a* of the contact element 6. The elastically deflected switching leg 5*a* presses against the contact portion 6*a* and causes an electrically conductive contact between the contact spring 5 and the contact element 6. The supported portion 5*e* of the fixed leg 5*b* is arranged on the insulating portion 2*e* on electrically insulating material which conducts the force flux coming from the support members 3*e* of the shield 3 into the fixed leg 5*b*.

The spring force fluxes 7, 8 result from the biased contact spring 5. The closed force flux 8 results from the spring force K which acts as contact force onto the contact element 6. The contact spring 5 exerts the spring force K at the end of the switching leg 5*a*. At the point where the spring force K acts on the contact portion 6*a*, a reaction force R1 is generated. The reaction force R1 causes the force flow 8, which is guided through the contact element 6, the insulating portion 2*f* and the shield 3 to the insulating portion 2*e* where the force flow 8 returns to the contact spring 5. At the supported portion 5*e* of the contact spring 5 a second reaction force R2 is generated. As the reaction forces R1 and R2 acting upon the contact spring 5 are not in line, a moment is generated which results in a third reaction force R3. Each reaction force R1, R2, R3 is opposed by a spring force K, S1, S2.

Each spring force K, S1, S2 is guided in a spring force flux 7, 8 into the shield 3. Hence, the spring force fluxes 7, 8 are guided in a closed loop from the spring 5 to the shield 3 and back to the contact spring 5. Thereby the shield 3 serves as a clamp which embraces the spring force flux 7, 8 and avoids an impact of the spring forces onto the housing surrounding the shield 3. As the housing (not shown) is preferably made of insulating plastic material, the housing tends to weaken when the switch connector is soldered in a reflow oven. Therefore, the above described support of the contact spring avoids a loss of the contact force which may appear when the material of the housing softens.

An insulating portion of the housing 2 can be arranged between the supported portion 5*e* and the shield 3 to allow for transmitting a reaction force from the supported portion 5*e* against the insertion direction I to the shield 3. Preferably, the housing 2 is provided with a slot or groove (not shown) for receiving or for clamping the supported portion 5*e* of the fixed leg. The slot or groove can extend substantially transversally to the insertion direction I, in the direction of the spring bend 5*c*, up to an assembly opening 2*h* (shown in FIG. 5) of the housing 2 for receiving the contact spring 5.

Figure 4:
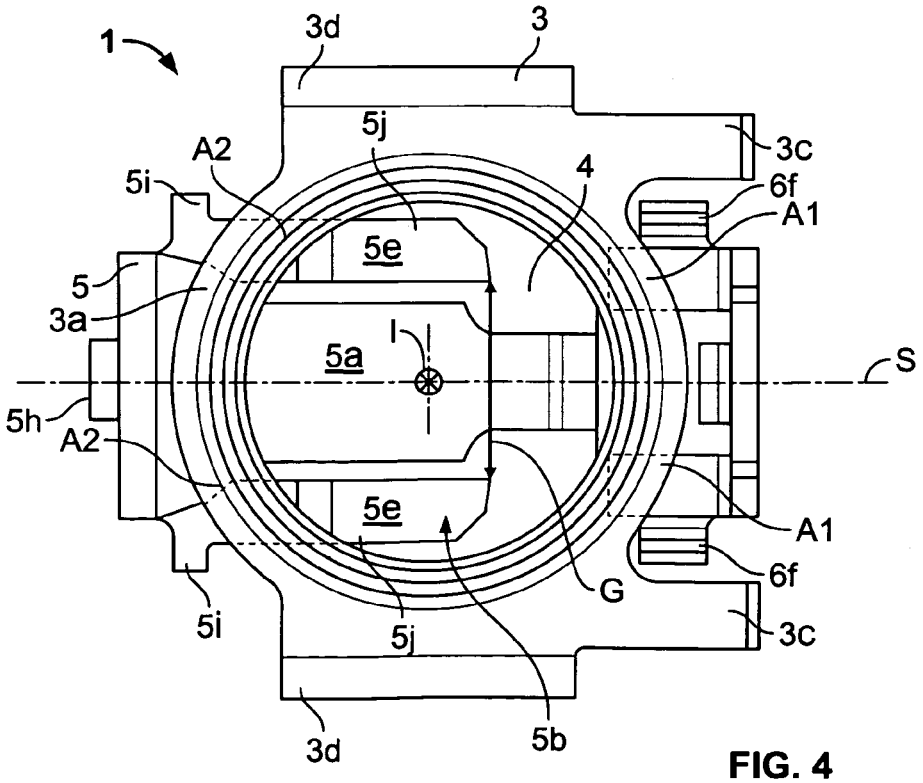
FIG. 4 is a schematic top view of a switch connector according to the invention without a housing.

FIG. 4 is a top view of the switch connector 1 according to the invention.

The shield 3 and the spring 5 are arranged symmetrically about a common plane of symmetry S. Thus, spring forces and/or reaction forces acting on the shield 3 or on the spring 5, for example, forces transmitted from the support members 3*e* as shown in FIG. 3 to the supported portions 5*e*, are situated symmetrically with regard to the plane of symmetry S.

All force transmitting portions of the spring 5 in the shown line of side, which corresponds to the insertion direction I are arranged directly under the shield 3 or next to the shield 3. For example, force transmitting areas A1 on the bottom side of the flange 3*a* transmit the contact force C generated by the switching leg 5*a* onto the shield 3. On the opposite side of the insertion opening 4 force transmitting areas A2 on the bottom side of the flange 3*a* transmit reaction forces supporting the spring 5 from the fixed leg 5*b* to the shield 3. As well as the spring 5 and the shield 3 the force transmitting areas A1, A2 are disposed symmetrically with regard to the plane of symmetry S.

The fixed leg 5*b* comprises two prongs 5*j* which are in insertion direction I arranged parallel and adjacent to the fixed leg 5*a*. These prongs 5*j* are bent or displaced upwardly against the insertion direction I to provide space for arranging the insulation portion 2*e* shown in FIG. 3. The prongs 5*j* border a gap G which is wider than the broadness of the switching leg 5*a*. Thereby, the switching leg 5*a* can be deflected in insertion direction I without interfering with the fixed leg 5*b* and the stroke or maximum deflection of the switching leg 5*a* is increased.

Figure 5:
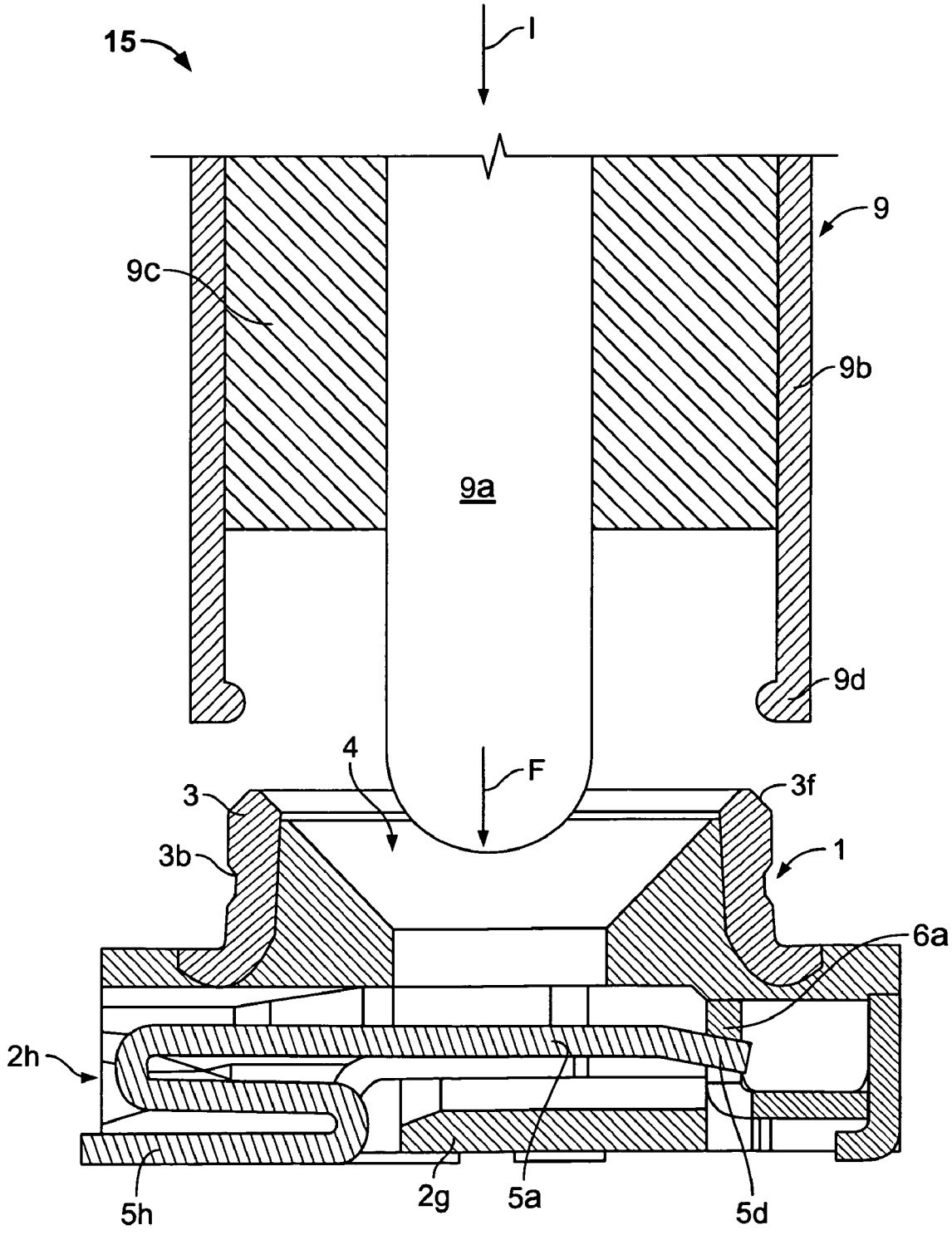
FIG. 5 is a schematic sectional side view of a connector assembly according to the invention comprising a switch connector and a mating connector.

FIG. 5 is a cross-sectional view of a connector assembly comprising a switch connector 1 according to the invention and a mating connector 9. Since the details of the switch connector illustrated therein are identical to the first embodiment, only the differences thereto will be considered. The reference numerals of FIGS. 1 to 4 will also be used as far as they relate to elements in FIG. 5 with identical function.

The mating connector 9 which is formed as a coaxial connector has a center conductor 9*a* and a ground conductor 9*b*. The center conductor 9*a* and the ground conductor 9*b* are insulated electrically by an insulation element 9*c*. At the end of the ground conductor 9*b* pointing in insertion direction I a counter-locking portion 9*d* is arranged, which is adapted to interfere with the locking portion 3*b* of the switch connector 1. A counter-locking portion 9*d* is formed as a circular protrusion which extends towards the center conductor 9*a*. When the mating conductor 9 is mated with the switch connector 1 the counter-locking portion 9*d* slides over a chamfered edge 3*f* of the shield 3 into the notch shaped locking portion 3*b*. While sliding over the shield 3, the ground conductor 9*b* is widened elastically. To facilitate the deflection at least of the end of the ground conductor 9*b* pointing in insertion direction I the ground conductor 9*b* can be provided with vertical slots extending in insertion direction.

When the center conductor 9*a* of the mating connector 9 is inserted into the insertion opening 4, a switching force F is exerted through the conductor 9*a* onto the switching leg 5*a*. The switching leg 5*a*, which is arranged adjacent to the insertion opening 4, is resiliently depressed by the center conductor 9*a*. By moving the switching leg 5*a* in insertion direction I the electrical contact between the contact portion 5*d* of the switching leg 5*a* and the contact portion 6*a* of the contact element 6 is broken. The switching leg 5*a* is arranged transversally through the insertion direction I, so that the switching direction, i.e. the moving direction of the contact portion 5*b* of the switching leg 5*a* is parallel to the insertion direction I.

The switching leg 5*a* can be moved up to a floor plate 2*g* which is formed from the housing 2. At a mated state, the center conductor 9*a* is connected electrically to the contact spring 5 which is electrically conductive. Thereby, an electrically conductive connection between the center conductor 9*a* and the spring terminal 5*h*, which may be connected electrically to a printed circuit board, is built up.

Due to the S-shaped profile of the contact spring 5 there is a gap between the housing 2 and the spring terminal 5*h*. The spring terminal 5*h* is connected to the housing by a bend. This bend allows for an increased distance between the spring terminal 5*h* and the housing 2, and the spring terminal 5*h* does not abut the housing. Thus, when the spring terminal 5*h* is soldered, the housing is not weakened by the soldering heat.

Figure 6:
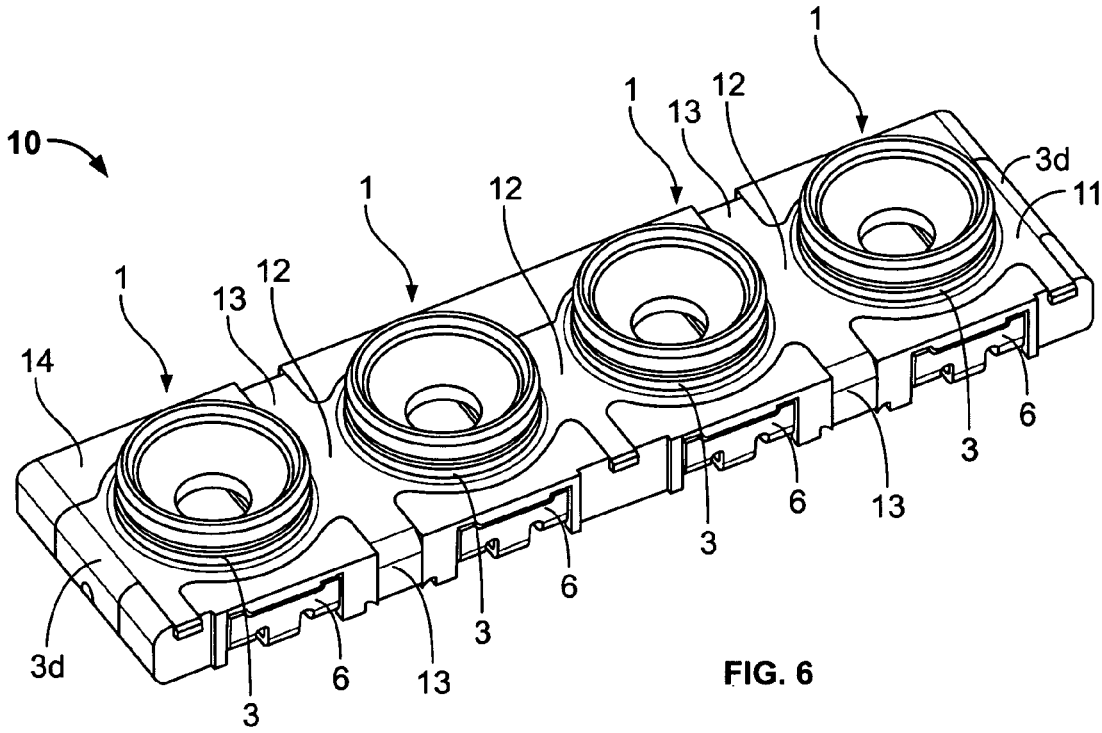
FIG. 6 is a perspective schematic view of a switch connector arrangement according to the invention comprising four fold switch connectors.

FIG. 6 shows a second embodiment of the present invention. Since most of the details illustrated therein are identical to the first embodiment, only the differences thereto will be described in more detail.

FIG. 6 shows a switch connector arrangement 10 comprising four switching connectors arranged in a row. The shields 3 of the four switching connectors 1 are formed from a common integral shield body 11. To connect the shields 3 to each other, between two shields 3 bridges 12 formed from the same sheet metal connect the shields 3 to each other.

As the clamping members 3*d* are arranged at opposing ends of the switch connector arrangement, the distance between the clamping members 3*d* is significantly larger than the distance between the clamping members 3 of the embodiment of FIGS. 1 to 5. Further clamping members 13 positioned at the lateral sides of the switch connector arrangement 10 supplement the support function of the clamping members 3*d*. The clamping members 13 each are arranged between a pair of switching connectors 3.

Figure 7:
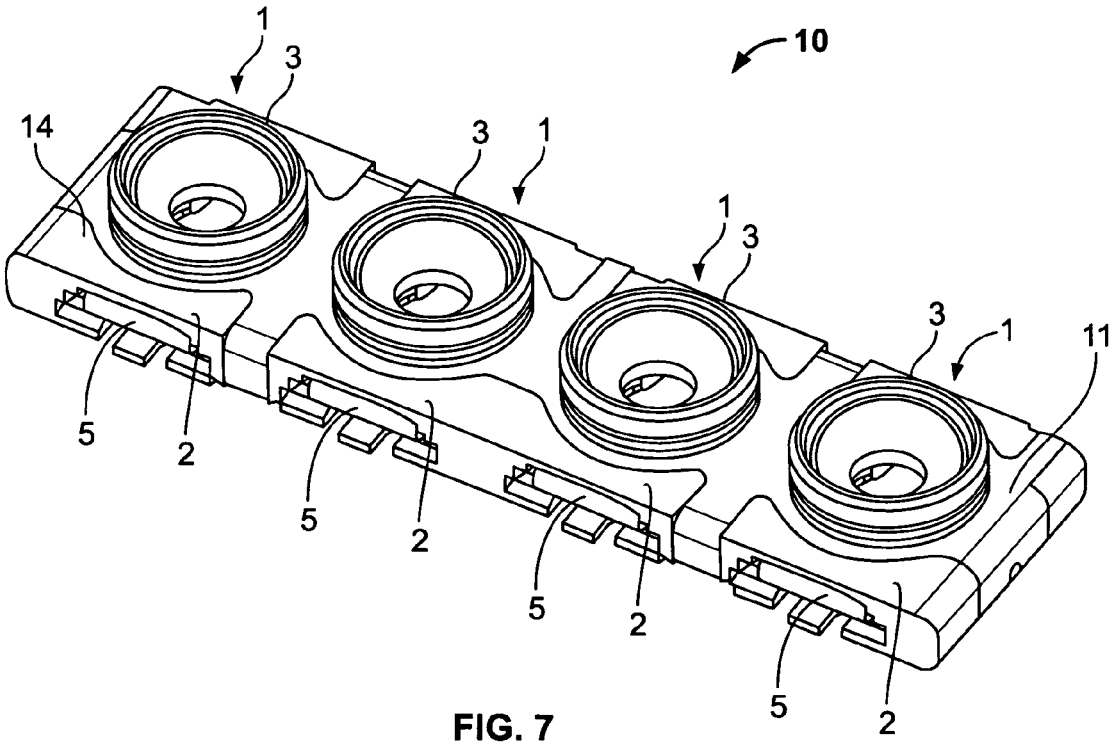
FIG. 7 is a further schematic perspective view of the switch connector arrangement according to FIG. 6.

FIG. 7 is a second perspective view of the switch connector arrangement of FIG. 6. Each switch connector 1 is provided with a contact spring 5. The housings 2 of the switch connectors 1 are formed from a single integral housing body 14. After manufacturing the shield body 11 from a single sheet metal, the shield body 11 is preferably over-molded by plastics to form the integral housing body 14.

Figure 8:
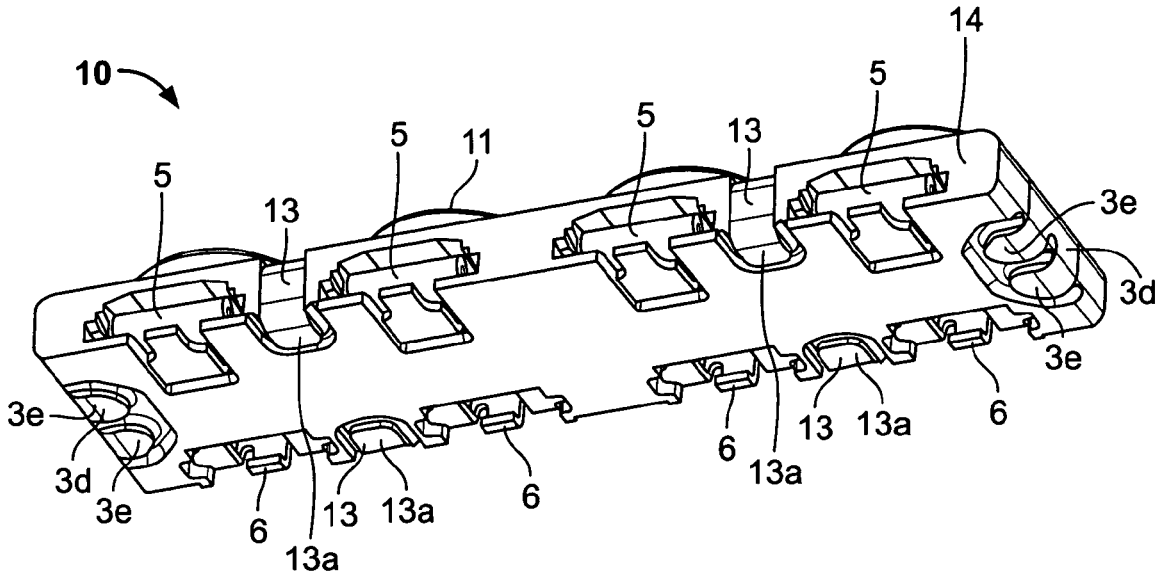
FIG. 8 is a third schematic perspective view of the switch connector arrangement according to FIGS. 6 and 7.

FIG. 8 is a schematic perspective bottom view of the shield connector arrangement. As well as the clamping members 3*d*, the clamping members 13 encompass the housing body 14 to mechanically connect the shield body 11 to the housing body 14 and to build up a spring force support. The clamping members 3*d* and 13 have support members 3*e* and 13*a* which serve for supporting the spring forces, for building up a closed force flux and for unloading the housing 14.

Figure 9:
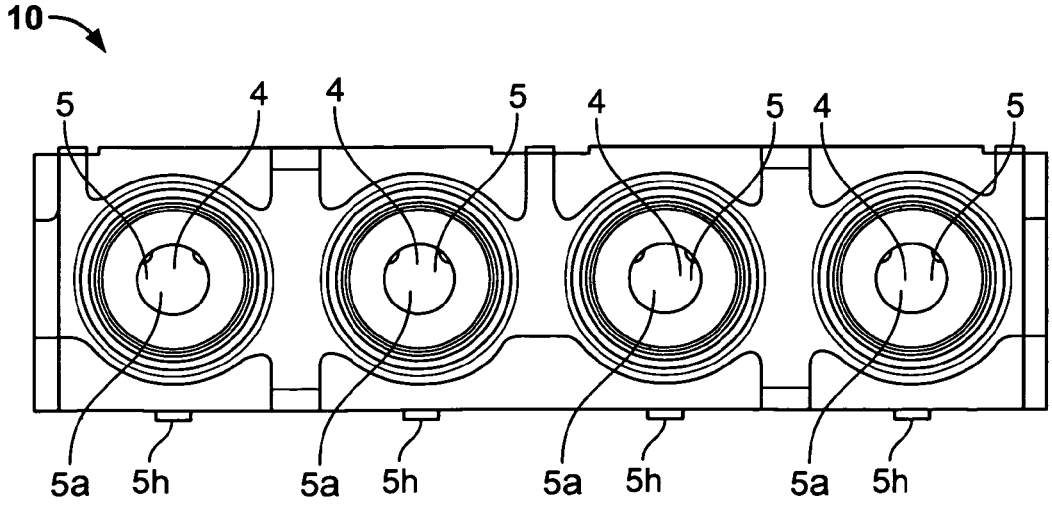
FIG. 9 is a schematic top view of the switch connector arrangement according to FIGS. 6 to 8.

FIG. 9 is a schematic top view of the switch connector arrangement 10.

The spring terminals 5*h* extend from the lateral side of the switch connector arrangement 10 to facilitate connecting the spring terminals 5*h* electrically conductive to a printed circuit board, for example by soldering. The insertion openings 4 are fully covered by the subjacent switching legs 5*a* of the contact springs 5.

The invention claimed is:

1. Switch connector for mounting on a printed circuit board, adapted to receive a mating connector in an insertion direction along an insertion axis (C), the switch connector comprising:

a shield;

a contact element;

a contact spring having at least one fixed leg, at least one elastically deflectable switching leg, and at least one spring bend, the fixed leg and the switching leg extending from the spring bend in a common direction and passing the insertion axis (C), the switching leg being adapted to be moved by insertion of the mating connector from a rest position, at which the switching leg exerts a spring force onto the contact element, to a switching position, at which the switching leg is spaced apart from the contact element;

at least one spring force flux that in the rest position is generated by the switching leg and guided in a closed loop to the fixed leg; and the shield being arranged in the closed loop of the spring force flux.

2. Switch connector according to claim 1, wherein the shield forms a clamp, said clamp surrounding the fixed leg and the switching leg.

3. Switch connector according to claim 1, wherein the shield comprises at least one support member, the fixed leg, in a projection direction which points in insertion direction, arranged in front of the support member.

4. Switch connector according to claim 3, wherein the fixed leg comprises a supported portion, the supported portion abutting the support member in insertion direction at the insertion axis.

5. Switch connector according to claim 1, wherein the switching leg and the fixed leg are arranged substantially transversally to the insertion direction.

6. Switch connector according to claim 1, wherein the switch connector comprises a housing, the shield encompassing the housing.

7. Switch connector according to claim 1, wherein the fixed leg comprises at least two prongs, a gap between the prongs adapted to receive the switching leg.

8. Switch connector according to claim 1, wherein the contact element has a substantially U-shaped profile, an opening of the U-shaped profile pointing towards the shield.

9. Switch connector arrangement comprising:

at least two switch connectors for mounting on a printed circuit board, adapted to receive a mating connector in an insertion direction along an insertion axis (C), each of the switch connector comprising:

a shield;

a contact element;

a contact spring having at least one fixed leg, at least one elastically deflectable switching leg, and at least one spring bend, the fixed leg and the switching leg extending from the spring bend in a common direction and passing the insertion axis (C), the switching leg being adapted to be moved by insertion of the mating connector from a rest position, at which the switching leg exerts a spring force onto the contact element, to a switching position, at which the switching leg is spaced apart from the contact element;

at least one spring force flux that in the rest position is generated by the switching leg and guided in a closed loop to the fixed leg; and the shields being arranged in the closed loop of the spring force flux and formed from a common integral shield body.

10. Switch connector arrangement comprising:

at least two switch connectors for mounting on a printed circuit board, adapted to receive a mating connector in an insertion direction along an insertion axis (C), each of the switch connector comprising:

a shield;

a contact element; and a contact spring having at least one fixed leg, at least one elastically deflectable switching leg, and at least one spring bend, the fixed leg and the switching leg extending from the spring bend in a common direction and passing the insertion axis (C), the switching leg being adapted to be moved by insertion of the mating connector from a rest position, at which the switching leg exerts a spring force onto the contact element, to a switching position, at which the switching leg is spaced apart from the contact element;

at least one spring force flux that in the rest position is generated by the switching leg and guided in a closed loop to the fixed leg; and a housing for the at least two switch connectors formed from a common integral housing body wherein the shield being arranged in the closed loop of the spring force flux.

11. A connector assembly, comprising:

a switch connector for mounting on a printed circuit board and defining an insertion axis (C), the switch connector comprising:

a contact element;

a contact spring having at least one fixed leg, at least one elastically deflectable switching leg, and at least one spring bend, the fixed leg and the switching leg extending from the spring bend in a common direction and passing the insertion axis (C);

a shield comprising at least one support member, and the fixed leg, in a projection direction which points in insertion direction, being arranged in front of the support member; and at least one spring force flux that in the rest position is generated by the switching leg and guided in a closed loop to the fixed leg; and the shield being arranged in the closed loop of the spring force flux; and a mating connector receivable in the insertion direction along an insertion axis, and configured to move and exert a switching force onto the switching leg when inserted, the switching force directed perpendicular to the support member and towards the center of the support member.

12. The connector assembly according to claim 11, wherein the mating connector comprises a ground conductor, the shield having a locking portion and the ground conductor having a counter locking portion, the locking portion adapted to interfere with the counter locking portion at a mated state of the connector assembly and to connect the ground conductor electrically to the shield.

* * * * *